US011293676B2

(12) United States Patent
Nishiyama et al.

(10) Patent No.: US 11,293,676 B2
(45) Date of Patent: Apr. 5, 2022

(54) REFRIGERATION CYCLE APPARATUS

(71) Applicant: Mitsubishi Electric Corporation, Tokyo (JP)

(72) Inventors: Takumi Nishiyama, Tokyo (JP); Kosuke Tanaka, Tokyo (JP); Kensaku Hatanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 28 days.

(21) Appl. No.: 15/776,137

(22) PCT Filed: Jan. 20, 2016

(86) PCT No.: PCT/JP2016/051581
§ 371 (c)(1),
(2) Date: May 15, 2018

(87) PCT Pub. No.: WO2017/126058
PCT Pub. Date: Jul. 27, 2017

(65) Prior Publication Data

US 2018/0328637 A1 Nov. 15, 2018

(51) Int. Cl.
*F25B 49/02* (2006.01)
*F04B 39/06* (2006.01)
(Continued)

(52) U.S. Cl.
CPC ..... *F25B 49/02* (2013.01); *F04B 39/06* (2013.01); *F04C 29/04* (2013.01); *F25B 5/02* (2013.01);
(Continued)

(58) Field of Classification Search
CPC ..... F25B 49/02; F25B 31/006; F25B 49/005; F25B 2600/2525; F25B 2700/1931;
(Continued)

(56) References Cited

U.S. PATENT DOCUMENTS 4,326,868 A * 4/1982 Ozu ..... F04C 29/042 417/284
2005/0217292 A1* 10/2005 Onishi ..... F25B 49/02 62/197
(Continued)

FOREIGN PATENT DOCUMENTS

CN 105121855 A 12/2015
JP 56-105257 A 8/1981
(Continued)

OTHER PUBLICATIONS

Masao, Closed Motor Compressor, Aug. 21, 1981, JPS56105257A, Whole Document (Year: 1981).*
(Continued)

*Primary Examiner* — Larry L Furdge
(74) *Attorney, Agent, or Firm* — Posz Law Group, PLC

(57) ABSTRACT

A refrigeration cycle apparatus in which a refrigerant having potential for disproportionation reaction circulates a first refrigerant flow path connected between a discharge side of the compressor and the condenser; a second refrigerant flow path connected between the condenser and the expansion valve; a third refrigerant flow path connected between the expansion valve and a suction side of the compressor; a jetting unit; a pressure measuring unit; and a temperature measuring unit. The jetting unit is configured to jet the refrigerant drawn from the second refrigerant flow path or the third refrigerant flow path to at least one of the compressor, the first refrigerant flow path and the second refrigerant flow path when at least one of a measured value of the pressure measuring unit and a measured value of the temperature measuring unit exceeds an allowed value.

6 Claims, 12 Drawing Sheets

(51) Int. Cl.

| | |
|---|---|
| ***F04C 29/04*** | (2006.01) |
| ***F25B 49/00*** | (2006.01) |
| ***F25B 31/00*** | (2006.01) |
| ***F25B 41/20*** | (2021.01) |
| ***F25B 41/31*** | (2021.01) |
| ***F25B 5/02*** | (2006.01) |
| ***F25B 6/02*** | (2006.01) |
| *F25B 13/00* | (2006.01) |
| *F25B 19/00* | (2006.01) |

(52) U.S. Cl.
CPC ..... *F25B 6/02* (2013.01); *F25B 31/006* (2013.01); *F25B 41/20* (2021.01); *F25B 41/31* (2021.01); *F25B 49/005* (2013.01); *F25B 13/00* (2013.01); *F25B 19/005* (2013.01); *F25B 2500/07* (2013.01); *F25B 2500/08* (2013.01); *F25B 2600/2507* (2013.01); *F25B 2600/2525* (2013.01); *F25B 2700/193* (2013.01); *F25B 2700/1931* (2013.01); *F25B 2700/2115* (2013.01); *F25B 2700/21152* (2013.01)

(58) Field of Classification Search
CPC ..... F25B 5/02; F25B 6/02; F25B 2500/07; F25B 2500/08; F25B 2600/2507; F25B 2700/193; F25B 2700/2115
See application file for complete search history.

(56) References Cited

U.S. PATENT DOCUMENTS

| | | | | |
|---|---|---|---|---|
| 2008/0236184 | A1* | 10/2008 | Morozumi ..... | F25B 1/04 62/324.6 |
| 2014/0070132 | A1 | 3/2014 | Fukushima | |
| 2014/0360218 | A1 | 12/2014 | Takenaka et al. | |
| 2015/0308701 | A1* | 10/2015 | Yamashita ..... | F25B 9/006 62/196.1 |

FOREIGN PATENT DOCUMENTS

| | | | | |
|---|---|---|---|---|
| JP | S56105257 | A | * | 8/1981 |
| JP | H04161760 | A | * | 6/1992 |
| JP | 10-176866 | A | | 6/1998 |
| JP | 2003-139415 | A | | 5/2003 |
| JP | 2004301073 | A | * | 10/2004 |
| JP | 2004301074 | A | * | 10/2004 |
| JP | 2012026610 | A | * | 2/2012 |
| JP | 2013-002737 | A | | 1/2013 |
| WO | 2012/157764 | A1 | | 11/2012 |
| WO | 2013/111176 | A1 | | 8/2013 |
| WO | 2014/156743 | A1 | | 10/2014 |

OTHER PUBLICATIONS

Shin et al., Refrigerant Circuit System, Feb. 9, 2012, JP2012026610A, Whole Document (Year: 2012).*
Kurita et al., Semi-Hermetic Multistage Compressor, Oct. 28, 2004, JP2004301073A, Whole Document (Year: 2004).*
Kurita et al., Semi Hermetic Multistage Compressor, Oct. 28, 2004, JP2004301074A, Whole Document (Year: 2004).*
Aoyama et al., Air Cooled Heat Pump Type Freezing Cycle having Reversible Expansion Valve, Jun. 5, 1992, JPH04161760A, Whole Document (Year: 1992).*
Extended European Search Report dated Dec. 5, 2018 issued in corresponding EP patent application No. 16886300 9.
International Search Report of the International Searching Authority dated Apr. 12, 2016 for the corresponding international application No. PCT/JP2016/051581 (and English translation).
Office Action dated Jun. 4, 2019 issued in corresponding JP patent application No. 2017-562215 (and English translation).

* cited by examiner

REFRIGERATION CYCLE APPARATUS

CROSS REFERENCE TO RELATED APPLICATION

This application is a U.S. national stage application of International Application No. PCT/JP2016/051581, filed on Jan. 20, 2016, the contents of which are incorporated herein by reference.

TECHNICAL FIELD

The present invention relates to refrigeration cycle apparatuses, and more particularly to a refrigeration cycle apparatus enclosing a refrigerant having potential for disproportionation reaction.

BACKGROUND

WO 2012/157764 (PTD 1) discloses a heat cycle system employing a working medium for heat cycle containing HFO1123. PTD 1 discloses that the working medium for heat cycle containing HFO1123 is a working medium for heat cycle that has a low global warming potential (GWP) and is excellent in cycle performance (capacity).

PATENT DOCUMENT

PTD 1: WO 2012/157764

The heat cycle system described in PTD 1, however, is problematic in that it causes disproportionation reaction of a refrigerant under high temperature and high pressure. If, upon failure of a compressor, for example, the compressor is operated while a refrigerant circuit is closed due to a malfunction of a four-way valve or the like, or the compressor is operated with insufficient heat exchange due to a malfunction of a fan of an outdoor unit, or the compressor is operated while a pipe unit connected to the outdoor unit is closed, some of the refrigerant is placed under high temperature and high pressure in the above-described heat cycle system. As a result, disproportionation reaction of the refrigerant may occur in the above-described heat cycle system under the high temperature and high pressure.

SUMMARY

The present invention has been made to solve the problem as described above. A main object of the present invention is to provide a refrigeration cycle apparatus that suppresses disproportionation reaction of a refrigerant.

A refrigeration cycle apparatus according to the present invention is a refrigeration cycle apparatus in which a refrigerant having potential for disproportionation reaction circulates through a compressor, a condenser, an expansion valve and an evaporator in this order. The refrigeration cycle apparatus includes: a first refrigerant flow path connected between a discharge side of the compressor and the condenser; a second refrigerant flow path connected between the condenser and the expansion valve; a third refrigerant flow path connected between the expansion valve and a suction side of the compressor; a temperature measuring unit attached to one of the compressor and the first refrigerant flow path for measuring a temperature of the refrigerant; a pressure measuring unit attached to one of the compressor and the first refrigerant flow path for measuring a pressure of the refrigerant; and a jetting unit configured to jet the refrigerant drawn from the second refrigerant flow path or the third refrigerant flow path to at least one of the compressor, the first refrigerant flow path and the second refrigerant flow path when at least one of a measured value of the temperature measuring unit and a measured value of the pressure measuring unit exceeds an allowed value.

According to the present invention, a refrigeration cycle apparatus that suppresses disproportionation reaction of a refrigerant can be provided.

DETAILED DESCRIPTION

Embodiments of the present invention will be described hereinafter with reference to the drawings. It should be noted that the same or corresponding elements are designated by the same reference numbers in the following drawings and description thereof will not be repeated.

First Embodiment

Configuration of Refrigeration Cycle Apparatus

Figure 1:
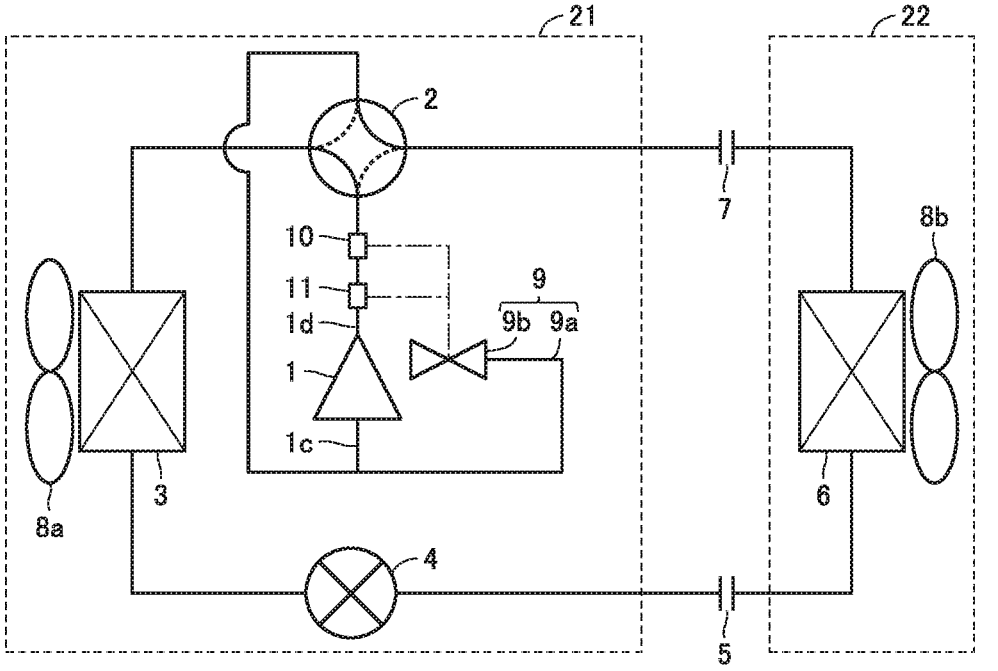
FIG. 1 is a diagram showing a refrigeration cycle apparatus according to a first embodiment.
Figure 2:
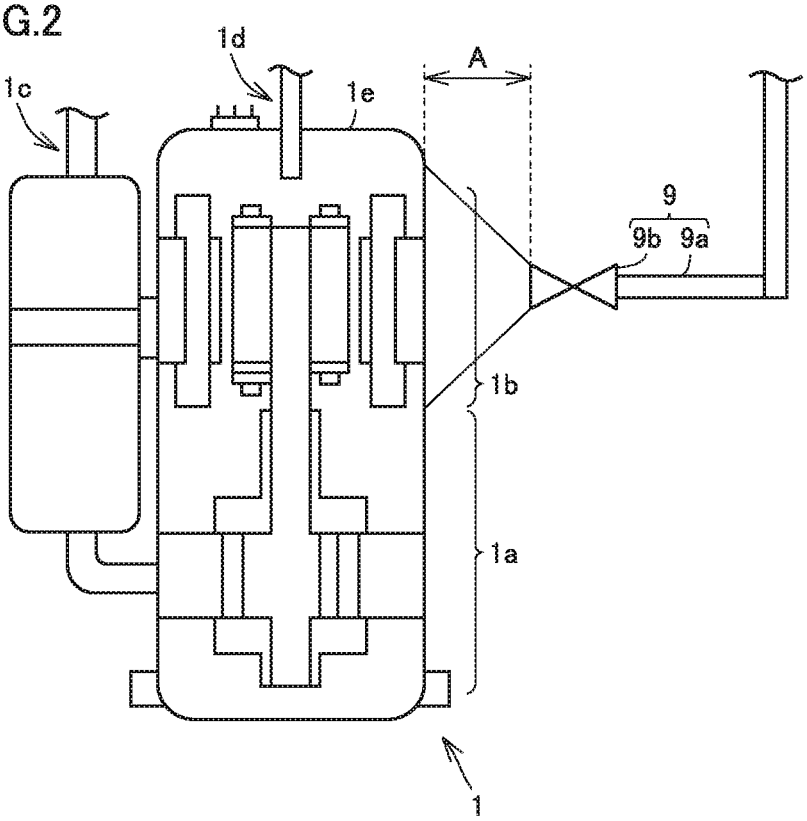
FIG. 2 is a diagram showing a jetting unit of the refrigeration cycle apparatus according to the first embodiment.

Referring to FIGS. 1 and 2, a refrigeration cycle apparatus 100 according to a first embodiment is described. Refrigeration cycle apparatus 100 includes a compressor 1, a four-way valve 2, an outdoor heat exchanger 3, an expansion valve 4, an extension pipe (liquid pipe) 5, an indoor heat exchanger 6, an extension pipe (gas pipe) 7, a fan 8 (an outdoor fan 8*a* and an indoor fan 8*b*), a jetting unit 9, a pressure measuring unit 10 and a temperature measuring unit 11. In refrigeration cycle apparatus 100, a refrigerant circulates through compressor 1, four-way valve 2, a condenser, expansion valve 4 and an evaporator in this order. In other words, in refrigeration cycle apparatus 100, the refrigerant circulates through a first refrigerant flow path connected between a discharge side of compressor 1 and the condenser, a second refrigerant flow path connected between the condenser and expansion valve 4, a fourth refrigerant flow path connected between expansion valve 4 and the evaporator, and a fifth refrigerant flow path connected between the evaporator and the discharge side of compressor 1 in this order. The fourth refrigerant flow path and the fifth refrigerant flow path are connected with the evaporator interposed therebetween, and form a third refrigerant flow path located between expansion valve 4 and a suction side of compressor 1.

In refrigeration cycle apparatus 100, compressor 1, four-way valve 2, outdoor heat exchanger 3, expansion valve 4, outdoor fan 8*a* and jetting unit 9 are accommodated in an outdoor unit 21, for example. In refrigeration cycle apparatus 100, indoor heat exchanger 6 and indoor fan 8*b* are accommodated in an indoor unit 22, for example. Outdoor unit 21 and indoor unit 22 are connected by extension pipes 5 and 7. The above-described refrigerant is a refrigerant having potential for disproportionation reaction, and is, for example, a mixed refrigerant containing HFO1123.

Compressor 1 is provided to be able to compress the above-described refrigerant. Compressor 1 may include any configuration but is a vertical rotary compressor as shown in FIG. 2, for example. Compressor 1 includes a slide unit 1*a* disposed downward in the vertical direction, a motor unit 1*b* disposed upward in the vertical direction, and a container 1*e* that accommodates slide unit 1*a* and motor unit 1*b*. Slide unit 1*a* includes a plurality of components such as a cylinder, a rolling piston and a vane. Slide unit 1*a* is driven by motor unit 1*b*. The above-described components of slide unit 1*a* slide relative to one another when driven by motor unit 1*b*. Motor unit 1*b* includes a coil unit, for example.

In refrigeration cycle apparatus 100, compressor 1 is connected to a suction side pipe 1*c* (a portion of the fifth refrigerant flow path) and a discharge side pipe 1*d* (a portion of the first refrigerant flow path). Slide unit 1*a* is connected to suction side pipe 1*c*. Suction side pipe 1*c* has one end connected to slide unit 1*a*, and the other end connected to one of ports of four-way valve 2. This one port of four-way valve 2 is connected to the evaporator. Discharge side pipe 1*d* has one end connected to internal space of container 1*e* above motor unit 1*b* in the vertical direction, and the other end connected to one of ports of four-way valve 2. This one port of four-way valve 2 is connected to the condenser. In compressor 1, the refrigerant compressed by slide unit 1*a* is discharged upward in the vertical direction from slide unit 1*a*, passes through motor unit 1*b* and is discharged to discharge side pipe 1*d*.

Four-way valve 2 is provided to be able to switch the flow path for the above-described refrigerant. Four-way valve 2 has four ports. Two of the ports of four-way valve 2 are connected to suction side pipe 1*c* and discharge side pipe 1*d* of compressor 1, respectively, as described above. The other two ports of four-way valve 2 are connected to outdoor heat exchanger 3 and indoor heat exchanger 6, respectively. Four-way valve 2 is provided to be able to switch between a cooling cycle state during cooling operation (see solid lines in FIG. 1) and a heating cycle state during heating operation (see broken lines in FIG. 1) in response to a signal from a switching device (not shown).

Outdoor heat exchanger 3 exchanges heat between the refrigerant and outdoor air. Indoor heat exchanger 6 exchanges heat between the refrigerant and indoor air. With the switching of the refrigerant flow path by four-way valve 2, outdoor heat exchanger 3 acts as a condenser during the cooling operation, and as an evaporator during the heating operation. With the switching of the refrigerant flow path by four-way valve 2, indoor heat exchanger 6 acts as an evaporator during the cooling operation, and as a condenser during the heating operation. Outdoor heat exchanger 3 and indoor heat exchanger 6 are connected with compressor 1, four-way valve 2 and extension pipe 7 interposed therebetween. Outdoor heat exchanger 3 and indoor heat exchanger 6 are connected with expansion valve 4 and extension pipe 5 interposed therebetween.

Expansion valve 4 expands the refrigerant flowing from indoor heat exchanger 6 to outdoor heat exchanger 3 during the heating operation. Expansion valve 4 expands the refrigerant flowing from outdoor heat exchanger 3 to indoor heat exchanger 6 during the cooling operation. A liquid refrigerant flows through extension pipe 5 during the cooling operation and during the heating operation. A gas refrigerant flows through extension pipe 7 during the cooling operation and during the heating operation.

Jetting unit 9 is provided to be able to jet to compressor 1 a refrigerant (refrigerant R4 which will be described later) having a lower temperature than a refrigerant (refrigerant R1 which will be described later) discharged from compressor 1. Jetting unit 9 includes, for example, a pipe 9*a* branching from suction side pipe 1*c*, and a safety valve 9*b* connected to this pipe 9*a*. Safety valve 9*b* is provided at a position facing, for example, motor unit 1*b* of compressor 1 and spaced a distance A apart in the horizontal direction from container 1*e* of compressor 1 (see FIG. 2). A jet orifice of safety valve 9*b* is provided, for example, to be able to jet the refrigerant over a wide angle. Distance A is set such that the refrigerant can be jetted widely and efficiently to a jet target (for example, motor unit 1*b*). Jetting unit 9 can draw some of the refrigerant having a low temperature and a low pressure and flowing through suction side pipe 1*c*, and jet the drawn refrigerant to a large area of compressor 1. Jetting unit 9 may further include a nozzle (not shown) attached to the jet orifice of safety valve 9*b*, for example, for attaining a predetermined size of a range of flight (jet angle) of the jetted refrigerant.

Pressure measuring unit 10 is provided to be able to measure a pressure of the refrigerant (refrigerant R1 which will be described later) in discharge side pipe 1*d*. Temperature measuring unit 11 is provided to be able to measure a temperature of the refrigerant (refrigerant R1 which will be described later) in discharge side pipe 1*d*.

Jetting unit 9, pressure measuring unit 10 and temperature measuring unit 11 are connected to a control device (not shown), for example. The control device is provided to be able to drive jetting unit 9 (safety valve 9*b*) based on measured values of pressure measuring unit 10 and temperature measuring unit 11.

Operation of Refrigeration Cycle Apparatus

Referring now to FIGS. 1 and 2, the operation of refrigeration cycle apparatus 100 is described. Refrigeration cycle apparatus 100 is capable of performing cooling operation and heating operation. In refrigeration cycle apparatus 100, safety valve 9*b* of jetting unit 9 is closed during the cooling operation or during the heating operation. Refrigeration cycle apparatus 100 forms a refrigerant circuit indicated by the solid lines in FIG. 1 during the cooling operation. During the cooling operation, outdoor heat exchanger 3 acts as a condenser and indoor heat exchanger 6 acts as an evaporator. Refrigeration cycle apparatus 100 forms a refrigerant circuit indicated by the dotted lines in FIG. 1 during the heating operation. During the heating operation, outdoor heat exchanger 3 acts as an evaporator and indoor heat exchanger 6 acts as a condenser.

In refrigeration cycle apparatus 100, the above-described refrigerant circulates through the refrigerant circuit to periodically repeat the change of state of the above-described refrigerant. A gas refrigerant R1 having a high temperature and a high pressure that has been compressed by compressor 1 flows through the first refrigerant flow path connected between the discharge side of compressor 1 and the condenser (outdoor heat exchanger 3 during the cooling operation or indoor heat exchanger 6 during the heating operation). A liquid refrigerant R2 having a low temperature and a high pressure that has been obtained by isobaric cooling of above-described gas refrigerant R1 having a high temperature and a high pressure by the condenser flows through the second refrigerant flow path connected between the condenser and expansion valve 4. A liquid refrigerant R3 having a low temperature and a low pressure that has been obtained by expansion of above-described liquid refrigerant R2 having a low temperature and a high pressure by expansion valve 4 flows through the fourth refrigerant flow path connected between expansion valve 4 and the evaporator (indoor heat exchanger 6 during the cooling operation or outdoor heat exchanger 3 during the heating operation). A gas refrigerant R4 having a high temperature and a low pressure that has been obtained by isobaric heating of above-described liquid refrigerant R3 having a low temperature and a low pressure by the evaporator flows through the fifth refrigerant flow path (which includes suction side pipe 1*c*) connected between the evaporator and the suction side of compressor 1.

In refrigeration cycle apparatus 100, above-described refrigerant R1 discharged from compressor 1 has the highest temperature and the highest pressure both during the cooling operation and during the heating operation. The pressure and the temperature of above-described refrigerant R1 are measured by pressure measuring unit 10 and temperature measuring unit 11, respectively. The degree of opening of expansion valve 4 is controlled depending on the temperature of the refrigerant discharged from compressor 1 (discharge temperature), for example, during the cooling operation and during the heating operation.

Next, an example of a procedure for preventing disproportionation reaction of the refrigerant in refrigeration cycle apparatus 100 is described.

First, allowable temperature and pressure conditions for the refrigerant in refrigeration cycle apparatus 100 are predetermined from temperature and pressure conditions under which the disproportionation reaction of the refrigerant cannot occur. The allowed pressure value and the allowed temperature value vary depending on the refrigerant. If the refrigerant is a mixed refrigerant, the allowed pressure value and the allowed temperature value vary depending on the mixing ratio in the refrigerant. For example, it is preferable that the allowed pressure value and the allowed temperature value be set to lower values as a mixing ratio of HFO1123 in the refrigerant increases. For example, when the ratio of HFO1123 in the refrigerant is 100%, this refrigerant may undergo disproportionation reaction when placed under conditions of a high temperature of not less than 180° C. and a high pressure of not less than 9 MPa. For this reason, the allowed pressure value for this refrigerant is set to 3 MPa, for example, and the allowed temperature value for this refrigerant is set to 100° C., for example.

Refrigeration cycle apparatus 100 is then operated. During the operation of refrigeration cycle apparatus 100, the pressure of above-described refrigerant R1 is measured by pressure measuring unit 10, and it is determined whether or not the pressure is equal to or lower than the allowed pressure value by the above-described control device. At the same time, the temperature of above-described refrigerant R1 is measured by temperature measuring unit 11, and it is determined whether or not the temperature is equal to or lower than the allowed temperature value by the above-described control device.

Then, when it is detected by the above-described control device that the measured value of pressure measuring unit 10 has exceeded the allowed pressure value or that the measured value of temperature measuring unit 11 has exceeded the allowed temperature value, jetting unit 9 is driven by the control device. Specifically, safety valve 9*b* of jetting unit 9 is opened to jet above-described refrigerant R4 from safety valve 9*b* toward motor unit 1*b* of compressor 1. Here, the operation of compressor 1 is stopped and expansion valve 4 is fully opened. In addition, the operation of outdoor fan 8*a* and indoor fan 8*b* is stopped.

Safety valve 9*b* is maintained in the opened state until the refrigerant is no longer jetted, for example. The refrigerant jetting by jetting unit 9 is stopped when the refrigerant is no longer jetted from safety valve 9*b* maintained in the opened state. Alternatively, safety valve 9*b* may be stopped when it is determined by the control device that the measured value of pressure measuring unit 10 or temperature measuring unit 11 has reached a value equal to or lower than a predetermined value (for example, the above-described allowed value). After the refrigerant jetting by jetting unit 9 is stopped, there is insufficient or no refrigerant enclosed in the refrigerant flow paths of refrigeration cycle apparatus 100.

To operate refrigeration cycle apparatus 100 again, the refrigerant is enclosed again in the refrigerant flow paths of refrigeration cycle apparatus 100. In addition, if a failure such as a blockage is likely to occur in the refrigerant flow paths of refrigeration cycle apparatus 100, refrigeration cycle apparatus 100 that has been subjected to the above-described processing for preventing the disproportionation reaction of the refrigerant is replaced with a new and different refrigeration cycle apparatus 100.

Function and Effect

Next, the function and effect of refrigeration cycle apparatus 100 according to the first embodiment will be described. Refrigeration cycle apparatus 100 is a refrigeration cycle apparatus in which a refrigerant having potential for disproportionation reaction circulates through compressor 1, four-way valve 2, the condenser, expansion valve 4 and the evaporator in this order. Refrigeration cycle apparatus 100 further includes jetting unit 9, pressure measuring unit 10 and temperature measuring unit 11. Pressure measuring unit 10 is attached to the first refrigerant flow path connected between the discharge side of compressor 1 and the condenser and measures the pressure of the refrigerant. Temperature measuring unit 11 is attached to the first refrigerant flow path connected between the discharge side of compressor 1 and the condenser and measures the temperature of the refrigerant. Jetting unit 9 is provided to be able to jet to compressor 1 the refrigerant flowing through a portion (suction side pipe 1*c*) of the fifth refrigerant flow path connected between the suction side of compressor 1 and the evaporator, based on at least one of the measured values of temperature measuring unit 11 and pressure measuring unit 10.

Refrigerant R1 having the highest temperature and the highest pressure in refrigeration cycle apparatus 100 flows through the first refrigerant flow path connected between motor unit 1*b* of compressor 1 and the discharge side of compressor 1, and the condenser. Pressure measuring unit 10 and temperature measuring unit 11 can therefore directly measure the pressure and the temperature of the refrigerant most likely to undergo the disproportionation reaction in refrigeration cycle apparatus 100. If it is feared that the disproportionation reaction of the refrigerant might occur from the measured values of pressure measuring unit 10 and temperature measuring unit 11, jetting unit 9 can jet to motor unit 1*b* of compressor 1 above-described refrigerant R4 having a lower temperature and a lower pressure than above-described refrigerant R1 passing around motor unit 1*b*. Accordingly, compressor 1 is rapidly cooled by the refrigerant jetted from jetting unit 9, so that the disproportionation reaction of the refrigerant at compressor 1 is suppressed in refrigeration cycle apparatus 100. As a result, the reliability of refrigeration cycle apparatus 100 is improved.

In above-described refrigeration cycle apparatus 100, the jet orifice of safety valve 9*b* is provided to be able to jet the refrigerant over a wide angle. In addition, safety valve 9*b* is provided at a position spaced a distance A mm (see FIG. 2) or more apart in the horizontal direction from container le of compressor 1. Jetting unit 9 can therefore jet some of the refrigerant having a low temperature and a low pressure and flowing through suction side pipe 1*c* to a large area of compressor 1.

The refrigerant enclosed in above-described refrigeration cycle apparatus 100 contains HFO1123 having a GWP of 0. Thus, the refrigerant enclosed in refrigeration cycle apparatus 100 is low in the above-described GWP. If the refrigerant enclosed in above-described refrigeration cycle apparatus 100 is a mixed refrigerant containing 40% by mass of HFO1123 and 60% by mass of R32 having a GWP of 675, then a GWP of 405 can be obtained. If the refrigerant enclosed in above-described refrigeration cycle apparatus 100 is a mixed refrigerant containing 80% by mass of HFO1123 and 20% by mass of HFO1234yf having a GWP of 4, then a GWP of 0.8 can be obtained.

Second Embodiment

Figure 3:
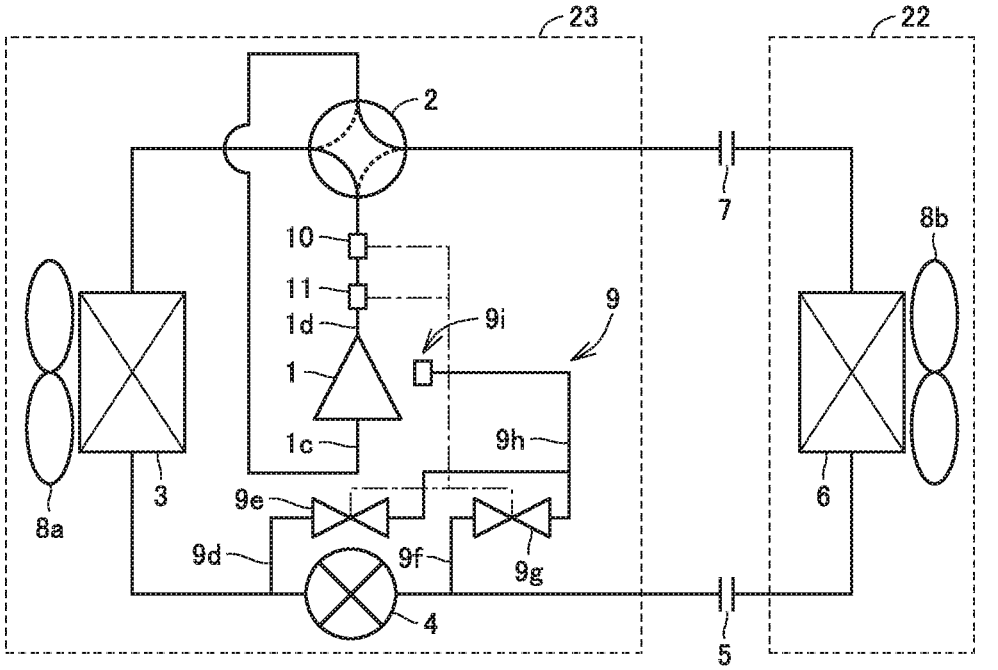
FIG. 3 is a diagram showing a refrigeration cycle apparatus according to a second embodiment.

Referring now to FIG. 3, a refrigeration cycle apparatus 101 according to a second embodiment is described. Refrigeration cycle apparatus 101 according to the second embodiment basically has a configuration similar to that of refrigeration cycle apparatus 100 according to the first embodiment, but is different in that, in an outdoor unit 23, jetting unit 9 is connected to the second refrigerant flow path connected between the condenser (outdoor heat exchanger 3 during the cooling operation or indoor heat exchanger 6 during the heating operation) and expansion valve 4, and to the fourth refrigerant flow path connected between expansion valve 4 and the evaporator.

Jetting unit 9 includes, for example, a pipe 9*d*, a safety valve 9*e* provided on pipe 9*d*, a pipe 9*f*, a safety valve 9*g* provided on pipe 9*f*, a junction pipe 9*h* connected to pipe 9*d* and pipe 9*f*, and a jet nozzle 9*i* provided at the tip of junction pipe 9*h*.

Pipe 9*d* is connected to the refrigerant flow path (the second refrigerant flow path or the fourth refrigerant flow path) through which outdoor heat exchanger 3 and expansion valve 4 are connected without compressor 1 interposed therebetween. Pipe 9*d* branches from the pipe having one end connected to outdoor heat exchanger 3 and the other end connected to expansion valve 4. Pipe 9*f* is connected to the refrigerant flow path (the fourth refrigerant flow path or the second refrigerant flow path) through which indoor heat exchanger 6 and expansion valve 4 are connected without compressor 1 interposed therebetween. Pipe 9*f* branches from the pipe having one end connected to expansion valve 4 and the other end connected to extension pipe 5.

It is preferable for jet nozzle 9*i* to include a configuration similar to that of safety valve 9*b* in refrigeration cycle apparatus 100 shown in FIG. 1. That is, jet nozzle 9*i* is provided, for example, at a position facing motor unit 1*b* of compressor 1 (see FIG. 2) and spaced distance A apart in the horizontal direction (see FIG. 2) from container le of compressor 1 (see FIG. 2). A jet orifice of jet nozzle 9*i* is provided, for example, to be able to jet the refrigerant over a wide angle. Distance A is set such that the refrigerant can be jetted widely and efficiently to a jet target (for example, motor unit 1*b*).

Refrigeration cycle apparatus 101 may operate similarly to refrigeration cycle apparatus 100 described above. In refrigeration cycle apparatus 101, safety valve 9*e* and safety valve 9*g* of jetting unit 9 are closed during the cooling operation or during the heating operation.

A procedure for preventing the disproportionation reaction of the refrigerant in refrigeration cycle apparatus 101 is basically similar to the procedure in refrigeration cycle apparatus 100 described above. However, refrigeration cycle apparatus 101 is different from refrigeration cycle apparatus 100 in that safety valve 9*e* or safety valve 9*g* is opened based on the measured values of pressure measuring unit 10 and temperature measuring unit 11. Moreover, in refrigeration cycle apparatus 101, the safety valve to be opened can be switched between during the cooling operation and during the heating operation. For example, safety valve 9*g* may be opened during the cooling operation of refrigeration cycle apparatus 101, and safety valve 9*e* may be opened during the heating operation. Accordingly, when it is detected by the above-described control device that the measured value of pressure measuring unit 10 has exceeded the allowed pressure value or that the measured value of temperature measuring unit 11 has exceeded the allowed temperature value, jetting unit 9 can be driven by the control device to jet above-described refrigerant R3 to compressor 1. Both during the cooling operation and during the heating operation, the refrigerant jetted from jetting unit 9 is refrigerant R3 flowing through the fourth refrigerant flow path between expansion valve 4 and the evaporator. Above-described refrigerant R3 has a lower temperature than above-described refrigerant R1 discharged from compressor 1, and can therefore cool compressor 1. As a result, refrigeration cycle apparatus 101 can produce similar function and effect to those of refrigeration cycle apparatus 100. When safety valve 9*e* or safety valve 9*g* is to be opened, the operation of compressor 1 is stopped and expansion valve 4 is fully opened. In addition, the operation of outdoor fan 8*a* and indoor fan 8*b* is stopped.

Preferably, safety valve 9*e* is opened during the cooling operation of refrigeration cycle apparatus 101, and safety valve 9*g* is opened during the heating operation of refrigeration cycle apparatus 101. Accordingly, when it is detected by the above-described control device that the measured value of pressure measuring unit 10 has exceeded the allowed pressure value or that the measured value of temperature measuring unit 11 has exceeded the allowed temperature value, jetting unit 9 can be driven by the control device to jet above-described refrigerant R2 to compressor 1. Here, both during the cooling operation and during the heating operation, the refrigerant jetted from jetting unit 9 is refrigerant R2 flowing through the second refrigerant flow path between the condenser and expansion valve 4. Above-described refrigerant R2 has a lower temperature than above-described refrigerant R1 discharged from compressor 1, and can therefore cool compressor 1. Furthermore, above-described refrigerant R2 is a liquid refrigerant having a high pressure, and can therefore have a cooling effect on compressor 1 by latent heat of vaporization.

In refrigeration cycle apparatus 101, jetting unit 9 may be connected at least between the condenser (outdoor heat exchanger 3 during the cooling operation or indoor heat exchanger 6 during the heating operation) and expansion valve 4, or between expansion valve 4 and the evaporator. For example, at least pipe 9*d* and safety valve 9*e*, or pipe 9*f* and safety valve 9*g* of jetting unit 9 may be connected to jet nozzle 9*i*. In this case, the same safety valve is opened in jetting unit 9 during the cooling operation and during the heating operation. The refrigerant jetted from jetting unit 9 during the cooling operation is different from the refrigerant jetted from jetting unit 9 during the heating operation.

Again, in this case, refrigerant R2 or refrigerant R3 having a lower temperature than gas refrigerant R1 having a high temperature and a high pressure that has been compressed by compressor 1 is jetted to compressor 1, so that cooling compressor 1 can be rapidly cooled to prevent the disproportionation reaction of the refrigerant.

Variations

Next, variations of refrigeration cycle apparatus 100 according to the first embodiment and refrigeration cycle apparatus 101 according to the second embodiment described above will be described.

In each of refrigeration cycle apparatuses 100 and 101, jetting unit 9 may be provided to be able to jet the refrigerant to a high pressure portion of the refrigerant flow paths. Specifically, jetting unit 9 may be provided to be able to jet the refrigerant drawn from the second refrigerant flow path (if a portion of the second refrigerant flow path is a jet target, then another portion of the second refrigerant flow path other than this portion) or the third refrigerant flow path to at least one of the first refrigerant flow path and the second refrigerant flow path located between the discharge side of compressor 1 and expansion valve 4, when at least one of the measured values of temperature measuring unit 11 and pressure measuring unit 10 exceeds the allowed value.

For example, jetting unit 9 may be provided to be able to jet refrigerant R4 flowing through the fifth refrigerant flow path connected between the suction side of compressor 1 and the evaporator to a portion of the first refrigerant flow path connected between the discharge side of compressor 1 and the condenser (a portion of the pipe connected between the discharge side of compressor 1 and the condenser). That is, jetting unit 9 may include pipe 9*a* connected to suction side pipe 1*c*, and safety valve 9*b* provided at a position facing a portion of the pipe connected between the discharge side of compressor 1 and the condenser.

For example, jetting unit 9 may be provided to be able to jet refrigerant R2 flowing through the second refrigerant flow path connected between the condenser and expansion valve 4 to a portion of the first refrigerant flow path connected between the discharge side of compressor 1 and the condenser. That is, jetting unit 9 may include pipe 9*d* connected to the pipe connected between outdoor heat exchanger 3 and expansion valve 4, pipe 9*f* connected to the pipe connected between indoor heat exchanger 6 and expansion valve 4, and jet nozzle 9*i* provided at a position facing a portion of the pipe connected between the discharge side of compressor 1 and the condenser.

Figure 16:
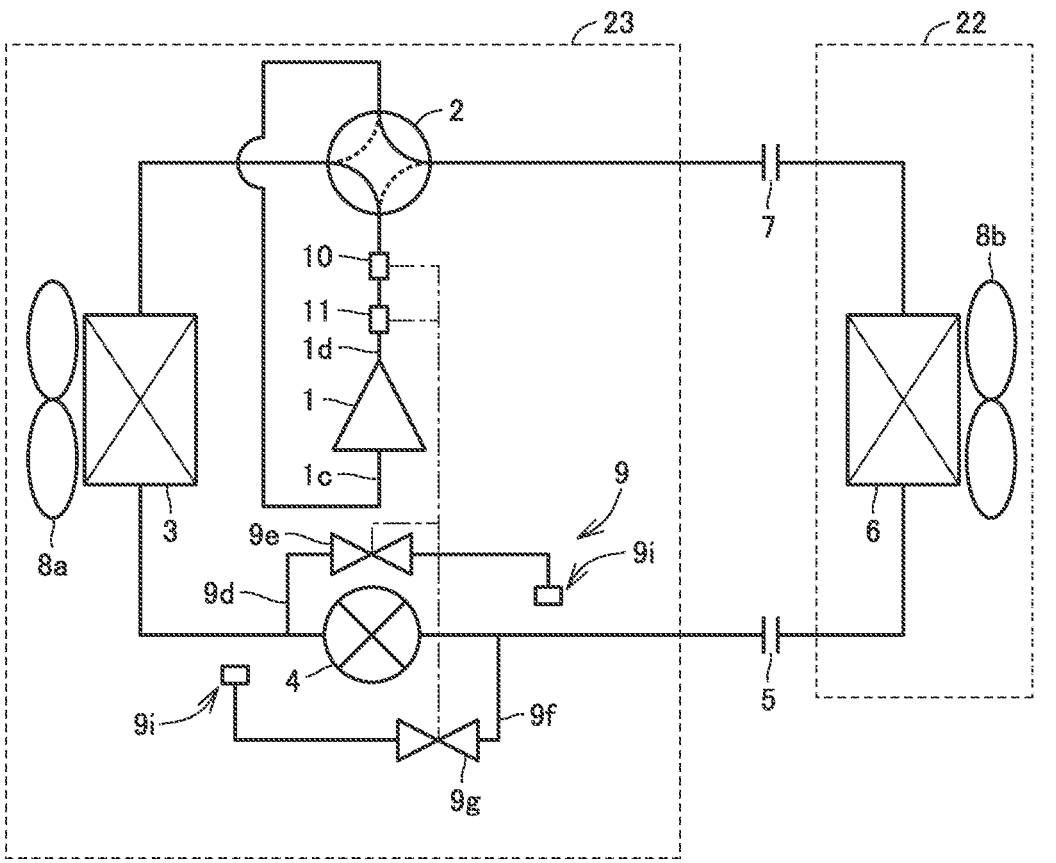
FIG. 16 is a diagram illustrating yet another variation of the refrigeration cycle apparatus according to the first or second embodiment.

For example, and referring to FIG. 16, jetting unit 9 may be provided to be able to jet refrigerant R3 flowing through the fourth refrigerant flow path connected between expansion valve 4 and the evaporator to a portion of the second refrigerant flow path connected between the condenser and expansion valve 4. That is, jetting unit 9 may include pipe 9*d* connected to the pipe connected between outdoor heat exchanger 3 and expansion valve 4, pipe 9*f* connected to the pipe connected between indoor heat exchanger 6 and expansion valve 4, and jet nozzle 9*i* provided at a position facing a portion of the pipe connected between the condenser and expansion valve 4. Jet nozzle 9*i* may be provided at a position facing a portion of the pipe connected between outdoor heat exchanger 3 and expansion valve 4, and may be provided at a position facing a portion of the pipe connected between expansion valve 4 and indoor heat exchanger 6.

In this case, during the cooling operation, the refrigerant that has flown through pipe 9*d* into junction pipe 9*h* upon opening of safety valve 9*e*, for example, may be jetted from the nozzle provided at a position facing a portion of the pipe connected between outdoor heat exchanger 3 and expansion valve 4. In addition, during the cooling operation, the refrigerant that has flown through pipe 9*f* into junction pipe 9*h* upon opening of safety valve 9*g*, for example, may be jetted from the nozzle provided at a position facing a portion of the pipe connected between outdoor heat exchanger 3 and expansion valve 4. During the heating operation, the refrigerant that has flown through pipe 9*d* into junction pipe 9*h* upon opening of safety valve 9*e*, for example, may be jetted from the nozzle provided at a position facing a portion of the pipe connected between indoor heat exchanger 6 and expansion valve 4. In addition, during the heating operation, the refrigerant that has flown through pipe 9*f* into junction pipe 9*h* upon opening of safety valve 9*g*, for example, may be jetted from the nozzle provided at a position facing a portion of the pipe connected between indoor heat exchanger 6 and expansion valve 4.

Each of safety valve 9*b* and jet nozzle 9*i* of jetting unit 9 may be disposed at a distance in the vertical direction or horizontal direction from each of the jet targets described above.

Again, in this case, if it is feared that the disproportionation reaction of the refrigerant might occur in refrigeration cycle apparatus 100 at the high pressure portion or high temperature portion (a portion of the first refrigerant flow path and the second refrigerant flow path located between the discharge side of compressor 1 and expansion valve 4) where the disproportionation reaction may occur, the liquid refrigerant having a high pressure comparable to that of the refrigerant flowing through this high pressure portion or high temperature portion, or the liquid refrigerant or gas refrigerant having a lower temperature than that of the refrigerant flowing through this high pressure portion or high temperature portion can be jetted to this portion by jetting unit 9. As a result, the disproportionation reaction of the refrigerant can be prevented as described above. Alternatively, jetting unit 9 may be provided, for example, to be able to jet refrigerant R2 flowing through a portion of the second refrigerant flow path connected between the condenser and expansion valve 4 to another portion of the second refrigerant flow path. Again, in this case, the liquid refrigerant having a high pressure comparable to that of the liquid refrigerant flowing through the second refrigerant flow path is jetted from jetting unit 9 to the second refrigerant flow path, so that the jet target in the second refrigerant flow path can be cooled by latent heat of vaporization of the jetted liquid refrigerant, to prevent the disproportionation reaction of the refrigerant.

Figure 4:
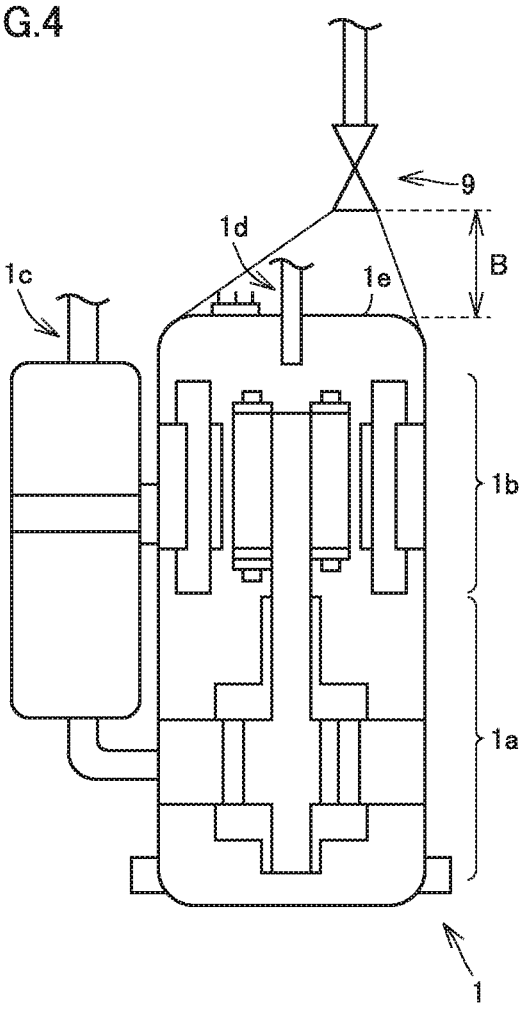
FIG. 4 is a diagram showing a variation of the refrigeration cycle apparatus according to the first or second embodiment.

In each of refrigeration cycle apparatuses 100 and 101, jetting unit 9 may be provided to be able to jet the refrigerant to compressor 1 from above in the vertical direction. Referring to FIG. 4, safety valve 9*b* of jetting unit 9 in refrigeration cycle apparatus 100 (see FIG. 1) may be provided at a position facing, for example, motor unit 1*b* of compressor 1 and spaced a distance B apart in the vertical direction from container 1*e* of compressor 1. Similarly, jet nozzle 9*i* of jetting unit 9 in refrigeration cycle apparatus 101 shown in FIG. 3 may be provided at the position facing, for example, motor unit 1*b* of compressor 1 and spaced distance B (see FIG. 4) apart in the vertical direction from container 1*e* of compressor 1. Again, in this case, compressor 1 can be cooled by the refrigerant jetted from jetting unit 9, to prevent the disproportionation reaction of the refrigerant in compressor 1.

Figure 5:
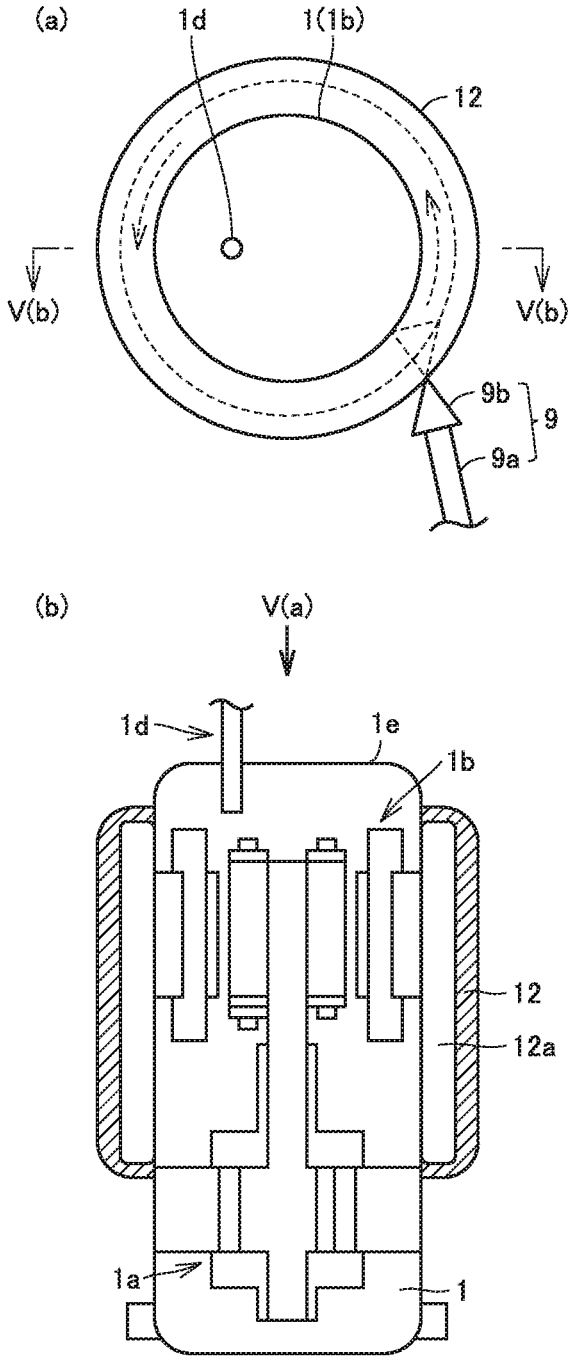
FIG. 5 is a diagram showing another variation of the refrigeration cycle apparatus according to the first or second embodiment.

In each of refrigeration cycle apparatuses 100 and 101, the jet target that receives the refrigerant jetting from jetting unit 9 may include a guide unit for limiting a flow of the refrigerant jetted around the jet target. Referring to FIGS. 5 (*a*) and (*b*), compressor 1 may further include a guide unit 12 surrounding slide unit 1*a* or motor unit 1*b*. Guide unit 12 is provided with a hollow portion 12*a* at a position facing, for example, motor unit 1*b*. Jetting unit 9 is provided to be able to jet the refrigerant into hollow portion 12*a*. For example, the jet orifice of safety valve 9*b* is buried in hollow portion 12*a*. Guide unit 12 may be provided with hollow portion 12*a* at a position facing at least one of slide unit 1*a* and motor unit 1*b*. Although FIGS. 5 (*a*) and (*b*) shows a variation in which compressor 1 of refrigeration cycle apparatus 100 shown in FIG. 1 includes guide unit 12, compressor 1 of refrigeration cycle apparatus 100 shown in FIG. 3 may similarly include guide unit 12 (see FIG. 5). In this case, the jet orifice of jet nozzle 9*i* (see FIG. 3) may be buried in hollow portion 12*a*. Accordingly, the flow around the jet target of the refrigerant jetted from jetting unit 9 to the jet target can be limited by guide unit 12, so that the jet target can be efficiently cooled. As a result, the disproportionation reaction of the refrigerant at the jet target can be prevented.

Each of refrigeration cycle apparatuses 100 and 101 may further include a cooling device provided to be able to cool a high pressure portion or high temperature portion of the refrigerant flow paths during the operation such as the cooling operation or the heating operation.

Figure 6:
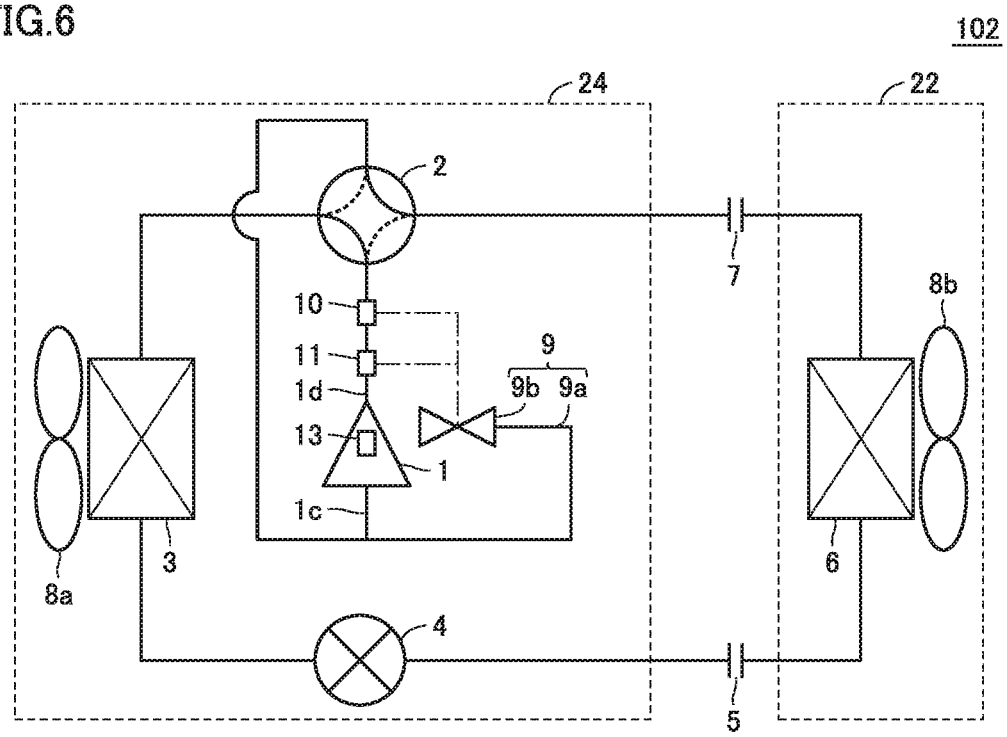
FIG. 6 is a diagram illustrating yet another variation of the refrigeration cycle apparatus according to the first or second embodiment.

Referring to FIG. 6, a refrigeration cycle apparatus 102 basically has a configuration similar to that of refrigeration cycle apparatus 100 shown in FIG. 1, but is different from refrigeration cycle apparatus 100 in that it further includes a cooling unit 13 attached to compressor 1 and provided to be able to cool compressor 1. Cooling unit 13 may include any configuration but is a Peltier element, for example. Cooling unit 13 is connected to the control device (not shown), for example. In this case, the control device is provided to be able to drive cooling unit 13 and jetting unit 9 (safety valve 9*b*) based on the measured values of pressure measuring unit 10 and temperature measuring unit 11.

Figure 7:
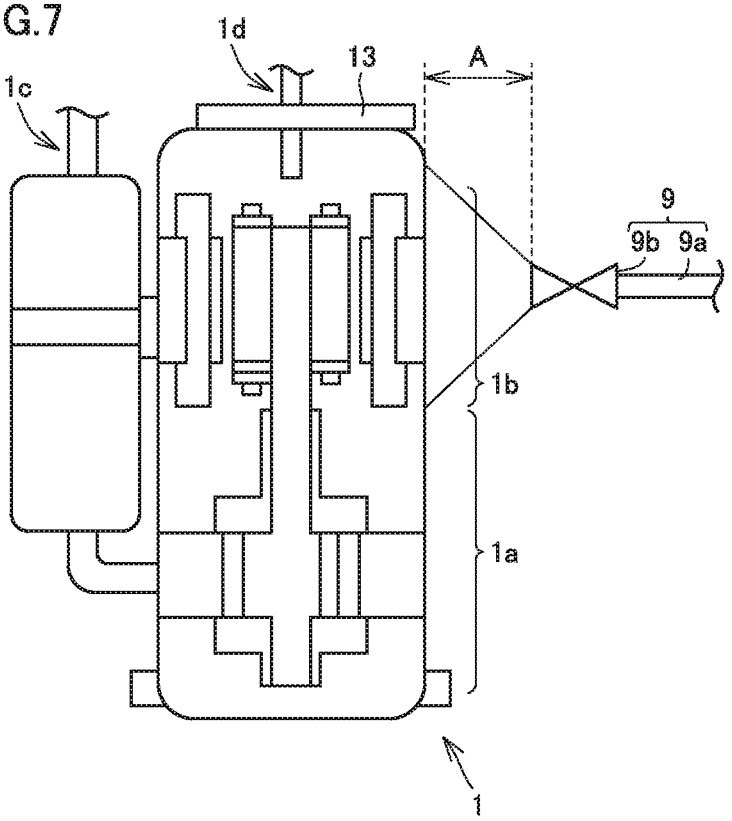
FIG. 7 is a diagram illustrating yet another variation of the refrigeration cycle apparatus according to the first or second embodiment.

Referring to FIG. 7, cooling unit 13 may be attached onto container 1*e* of compressor 1 above motor unit 1*b* in the vertical direction. In this case, jetting unit 9 may have safety valve 9*b* provided at a position spaced apart in the horizontal direction from container 1*e*. Cooling unit 13 may also be attached onto container 1*e* of compressor 1 at a position facing at least one of slide unit 1*a* and motor unit 1*b* in the vertical direction.

Figure 8:
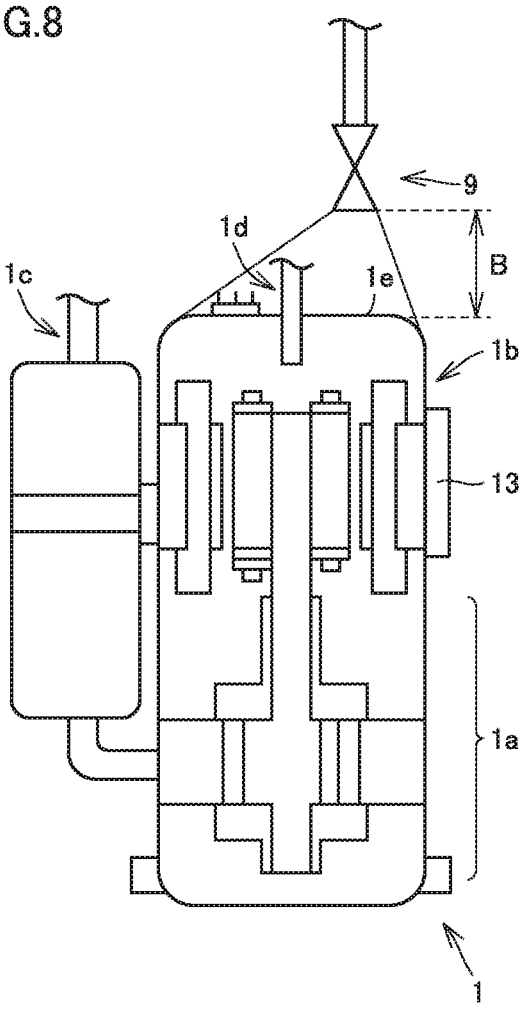
FIG. 8 is a diagram illustrating yet another variation of the refrigeration cycle apparatus according to the first or second embodiment.

Referring to FIG. 8, cooling unit 13 may be attached onto a side surface of container 1*e* of compressor 1 at a position facing motor unit 1*b*. In this case, jetting unit 9 may have safety valve 9*b* provided at a position spaced apart in the vertical direction from container 1*e*. Cooling unit 13 may also be attached onto the side surface of container 1*e* of compressor 1 at a position facing at least one of slide unit la and motor unit 1*b*.

Refrigeration cycle apparatus 102 may basically operate similarly to refrigeration cycle apparatus 100 described above, but is different in that the cooling operation on compressor 1 is performed by cooling unit 13 during the cooling operation and the heating operation. The cooling operation on compressor 1 by cooling unit 13 is started when, for example, using a pressure and a temperature lower than the above-described allowed values for determining the necessity for the refrigerant jetting by jetting unit 9 as reference values, the measured value of pressure measuring unit 10 or temperature measuring unit 11 exceeds this reference value. Then, the cooling operation on compressor 1 by cooling unit 13 is continued until, for example, the measured value of pressure measuring unit 10 or temperature measuring unit 11 reaches a value equal to or lower than a value immediately after the start of operation of refrigeration cycle apparatus 102. In refrigeration cycle apparatus 102, the refrigerant is jetted to compressor 1 by jetting unit 9 when it is determined that the measured value of pressure measuring unit 10 or temperature measuring unit 11 has exceeded the above-described allowed value regardless of the cooling operation by cooling unit 13.

Figure 9:
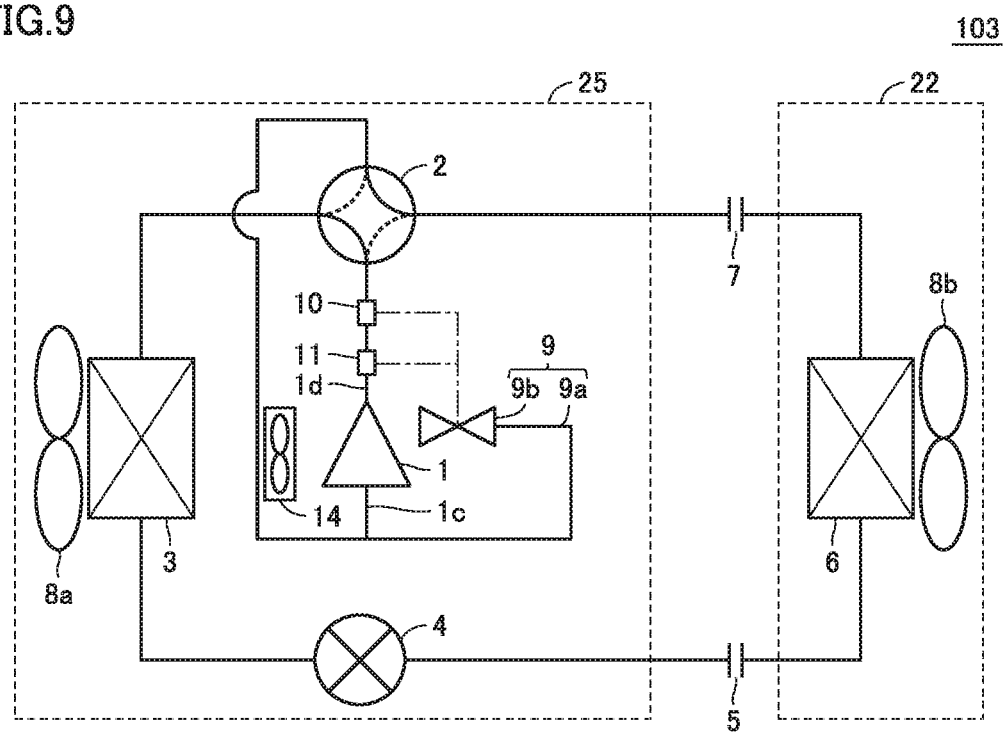
FIG. 9 is a diagram illustrating yet another variation of the refrigeration cycle apparatus according to the first or second embodiment.

Referring to FIG. 9, a refrigeration cycle apparatus 103 basically has a configuration similar to that of refrigeration cycle apparatus 100 shown in FIG. 1, but is different from refrigeration cycle apparatus 100 in that it further includes a fan 14 as a cooling device provided to be able to cool compressor 1. Fan 14 is connected to the control device (not shown), for example. In this case, the control device is provided to be able to drive fan 14 and jetting unit 9 (safety valve 9*b*) based on the measured values of pressure measuring unit 10 and temperature measuring unit 11.

Figure 10:
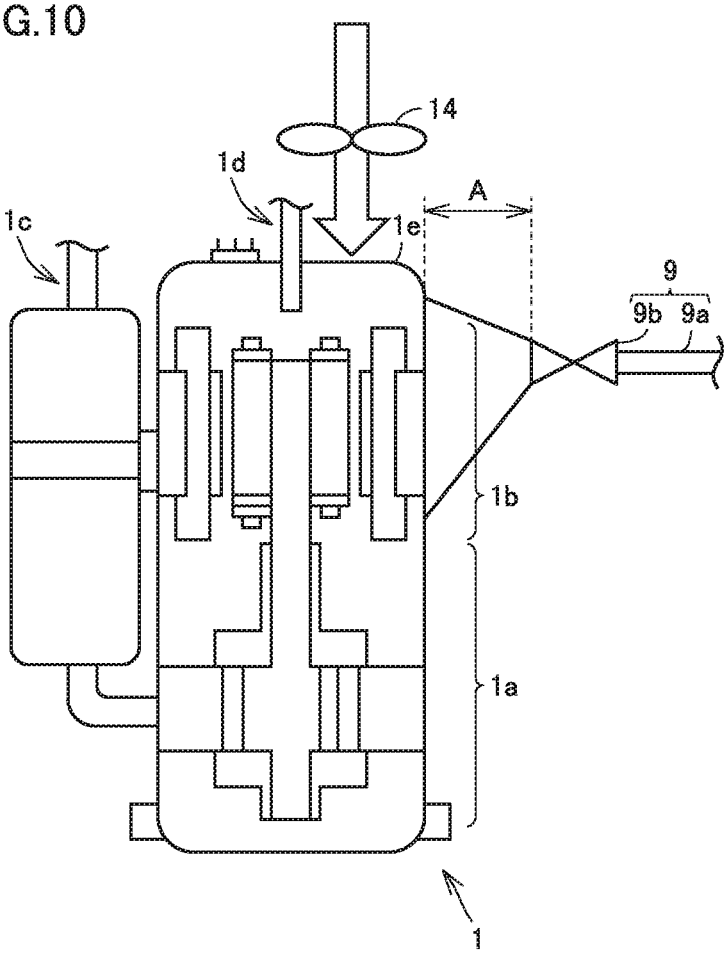
FIG. 10 is a diagram illustrating yet another variation of the refrigeration cycle apparatus according to the first or second embodiment.

Referring to FIG. 10, fan 14 may be provided to be able to blow the air to container 1*e* of compressor 1 from the top to the bottom in the vertical direction. In this case, jetting unit 9 may have safety valve 9*b* provided at a position spaced apart in the horizontal direction from container 1*e*. Fan 14 may also be provided to be able to blow the air to container 1*e* of compressor 1 from the bottom to the top in the vertical direction.

Figure 11:
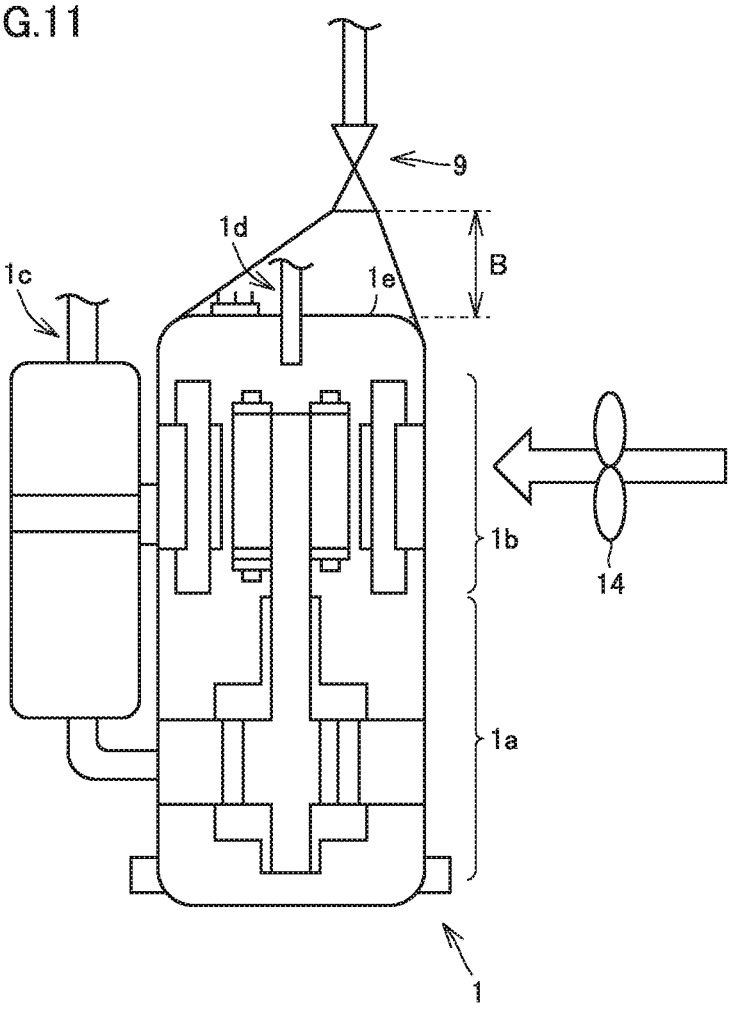
FIG. 11 is a diagram illustrating yet another variation of the refrigeration cycle apparatus according to the first or second embodiment.

Referring to FIG. 11, fan 14 may be provided to be able to blow the air to container 1*e* of compressor 1 in the horizontal direction. Fan 14 may be provided to be able to blow the air to at least one of slide unit 1*a* and motor unit 1*b*. In this case, jetting unit 9 may have safety valve 9*b* provided at a position spaced apart in the vertical direction from container 1*e*. Fan 14 may also be provided to be able to blow the air to container 1*e* of compressor 1 from the bottom to the top in the vertical direction.

Refrigeration cycle apparatus 103 may basically operate similarly to refrigeration cycle apparatus 100 described above, but is different in that the cooling operation on compressor 1 is performed by fan 14 during the cooling operation and the heating operation. The cooling operation on compressor 1 by fan 14 is started when, for example, using a pressure and a temperature lower than the above-described allowed values for determining the necessity for the refrigerant jetting by jetting unit 9 as reference values, the measured value of pressure measuring unit 10 or temperature measuring unit 11 exceeds this reference value. Then, the cooling operation on compressor 1 by fan 14 is continued until, for example, the measured value of pressure measuring unit 10 or temperature measuring unit 11 reaches a value equal to or lower than a value immediately after the start of operation of refrigeration cycle apparatus 103. In refrigeration cycle apparatus 103, the refrigerant is jetted to compressor 1 by jetting unit 9 when it is determined that the measured value of pressure measuring unit 10 or temperature measuring unit 11 has exceeded the above-described allowed value regardless of the cooling operation by fan 14. Here, it is preferred to stop the operation of fan 14 when the refrigerant is jetted by jetting unit 9. The operation of fan 14 may be restarted after the refrigerant jetting by jetting unit 9 is completed.

Each of refrigeration cycle apparatuses 102 and 103 including each cooling device shown in FIGS. 6 to 11 can cool the high pressure portion or high temperature portion of the refrigerant flow path by the cooling device both during the cooling operation and the heating operation, thereby suppressing the disproportionation reaction of the refrigerant. Furthermore, when the disproportionation reaction of the refrigerant cannot be suppressed sufficiently by the cooling action of the cooling device, the high pressure portion or high temperature portion can be cooled by the refrigerant jetted from jetting unit 9, to prevent the disproportionation reaction of the refrigerant at the high pressure portion or high temperature portion.

Each cooling device shown in FIGS. 6 to 11 and jetting unit 9 are preferably provided to be able to jet the refrigerant to the above-described jet target from a direction different from a direction in which the refrigerant flows through the jet target. At least one of each cooling device shown in FIGS. 6 to 11 and jetting unit 9 is preferably provided to be able to jet the refrigerant to the above-described jet target from a direction perpendicular to the direction in which the refrigerant flows through the jet target. As a result, since jetting unit 9 is provided to be able to jet the refrigerant over a wide range, the refrigerant can be jetted for a longer period of time to the refrigerant flowing through the above-described jet target.

Although each cooling device shown in FIGS. 6 to 11 is provided to be able to cool the high pressure portion or high temperature portion (compressor 1), which is the same as the jet target by jetting unit 9, the cooling target by each cooling device may be different from the jet target by jetting unit 9. For example, when jetting unit 9 is provided to be able to jet the refrigerant to a portion of the first refrigerant flow path connected between the discharge side of compressor 1 and the condenser as described above, the cooling device may be provided to be able to cool compressor 1. Alternatively, when jetting unit 9 is provided to be able to jet the refrigerant to compressor 1, the cooling device may be provided to be able to cool a portion of the first refrigerant flow path connected between the discharge side of compressor 1 and the condenser.

Each of refrigeration cycle apparatus 100 and refrigeration cycle apparatus 101 may further include each cooling device shown in FIGS. 6 to 11, thereby more effectively preventing the disproportionation reaction of the refrigerant.

Figure 12:
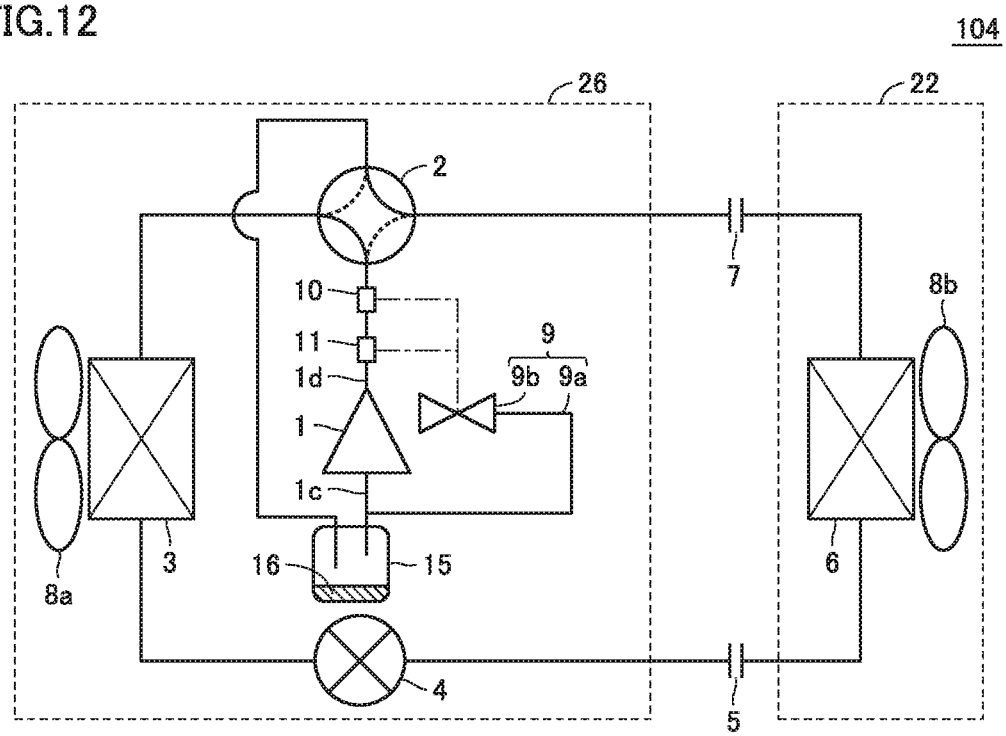
FIG. 12 is a diagram illustrating yet another variation of the refrigeration cycle apparatus according to the first or second embodiment.

Each of refrigeration cycle apparatuses 100 and 101 may include a non-azeotropic mixed refrigerant as the enclosed refrigerant, and may further include an adjusting unit capable of increasing the mixing ratio of a high-boiling refrigerant in this refrigerant suctioned into compressor 1. Referring to FIG. 12, a refrigeration cycle apparatus 104 basically has a configuration similar to that of refrigeration cycle apparatus 100, but is different from refrigeration cycle apparatus 100 in that it further includes an accumulator 15 and a heating unit 16 on the suction side of compressor 1.

The refrigerant enclosed in refrigeration cycle apparatus 104 is a non-azeotropic refrigerant including a mixture of HFO1123 and another refrigerant having a higher boiling point than HFO1123, for example, HFO1123yf or HFO1123ze. Accumulator 15 is connected between the suction side of compressor 1 and the evaporator (between the suction side of compressor 1 and four-way valve 2). Accumulator 15 accumulates an excess of the high-boiling refrigerant in refrigeration cycle apparatus 104. Heating unit 16 is provided to be able to heat and evaporate the high-boiling refrigerant accumulated in accumulator 15. Heating unit 16 is provided, for example, adjacent to the bottom, or a low position around the bottom, of a portion of accumulator 15 where the above-described refrigerant is accumulated. Heating unit 16 includes a band heater or a silicon rubber heater, for example.

Refrigeration cycle apparatus 104 may basically operate similarly to refrigeration cycle apparatus 100 described above, but is different in that the high-boiling refrigerant accumulated in accumulator 15 is evaporated by heating unit 16 during the cooling operation and the heating operation.

The heating operation on the high-boiling refrigerant by heating unit 16 is started when, for example, using a pressure and a temperature lower than the above-described allowed values for determining the necessity for the refrigerant jetting by jetting unit 9 as reference values, the measured value of pressure measuring unit 10 or temperature measuring unit 11 exceeds this reference value. As a result, the mixing ratio of the high-boiling refrigerant in a gaseous state can be increased in the non-azeotropic mixed refrigerant suctioned into compressor 1. Thus, the mixing ratio of HFO1123 in the refrigerant can be relatively lowered, to reduce the pressure and the temperature of the refrigerant discharged from compressor 1. The heating operation on the high-boiling refrigerant by heating unit 16 is continued until, for example, the measured value of pressure measuring unit 10 or temperature measuring unit 11 reaches a value equal to or lower than a value immediately after the start of operation of refrigeration cycle apparatus 102. In refrigeration cycle apparatus 102, the refrigerant is jetted to compressor 1 by jetting unit 9 when it is determined that the measured value of pressure measuring unit 10 or temperature measuring unit 11 has exceeded the above-described allowed value regardless of the above-described heating operation by heating unit 16. The above-described heating operation by heating unit 16 is stopped when the refrigerant is jetted by jetting unit 9.

In each of refrigeration cycle apparatuses 100, 101, 102, 103 and 104, pressure measuring unit 10 and temperature measuring unit 11 may be attached to compressor 1. Again, in this case, pressure measuring unit 10 and temperature measuring unit 11 can measure the pressure and the temperature of the refrigerant having the highest temperature and the highest pressure in each of refrigeration cycle apparatuses 100, 101, 102, 103 and 104. As a result, the refrigerant jetting is performed by jetting unit 9 to the above-described high pressure portion or high temperature portion based on the measured values of pressure measuring unit 10 and temperature measuring unit 11 attached to compressor 1, so that the disproportionation reaction of the refrigerant can be prevented in each of refrigeration cycle apparatuses 100, 101, 102, 103 and 104.

Figure 13:
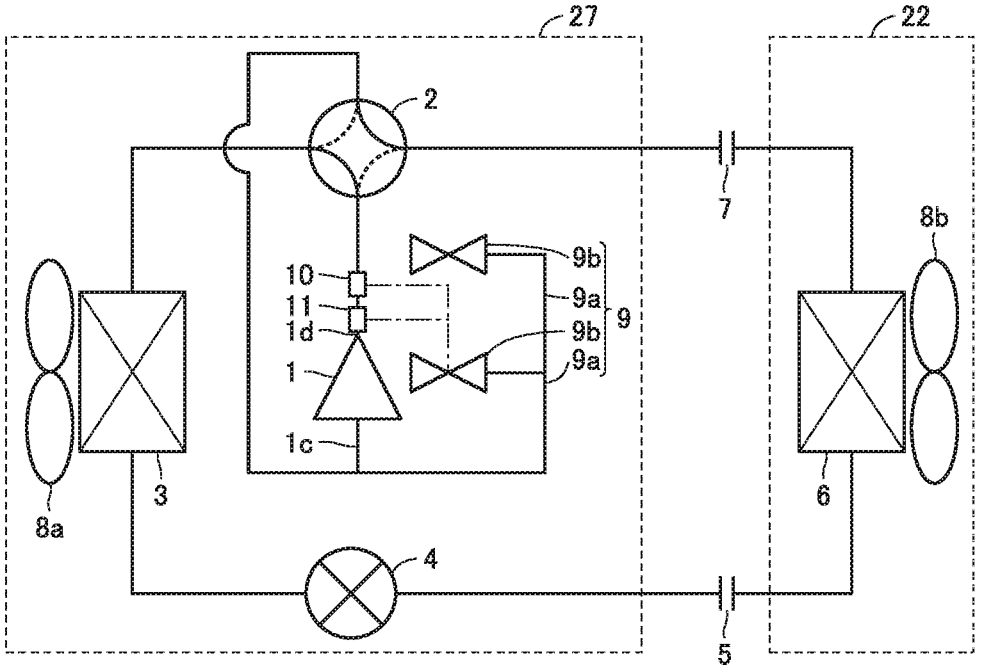
FIG. 13 is a diagram illustrating yet another variation of the refrigeration cycle apparatus according to the first or second embodiment.

In each of refrigeration cycle apparatuses 100, 101, 102, 103 and 104, one jetting unit 9 may include a plurality of safety valves 9*b* or jet nozzles 9*i*. Referring to FIG. 13, pipe 9*a* may be connected to the plurality of safety valves 9*b*. Junction pipe 9*h* may be connected to the plurality of jet nozzles 9*i*. The plurality of safety valves 9*b* or jet nozzles 9*i* may be provided to be able to jet the refrigerant to a portion (one jet target) of the first refrigerant flow path and the second refrigerant flow path located between the discharge side of compressor 1 and expansion valve 4. Alternatively, the plurality of safety valves 9*b* or jet nozzles 9*i* may be provided to be able to jet the refrigerant to portions different from each other of the first refrigerant flow path and the second refrigerant flow path located between the discharge side of compressor 1 and expansion valve 4. For example, referring to FIG. 13, one of the plurality of safety valves 9*b* may be provided to be able to jet the refrigerant to compressor 1, while the remainder of the plurality of safety valves 9*b* may be provided to be able to jet the refrigerant to a portion of the first refrigerant flow path connected between the discharge side of compressor 1 and the condenser. In addition, one of the plurality of jet nozzles 9*i* may be provided to be able to jet the refrigerant to compressor 1, while the remainder of the plurality of jet nozzles 9*i* may be provided to be able to jet the refrigerant to a portion of the first refrigerant flow path connected between the discharge side of compressor 1 and the condenser.

Figure 14:
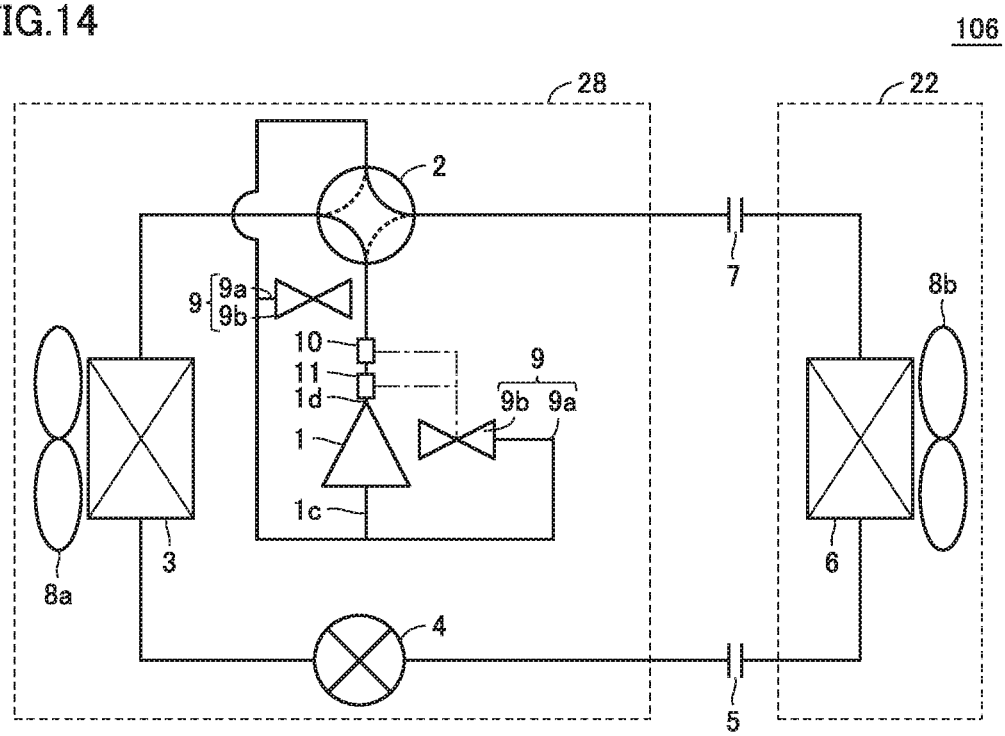
FIG. 14 is a diagram illustrating yet another variation of the refrigeration cycle apparatus according to the first or second embodiment.
Figure 15:
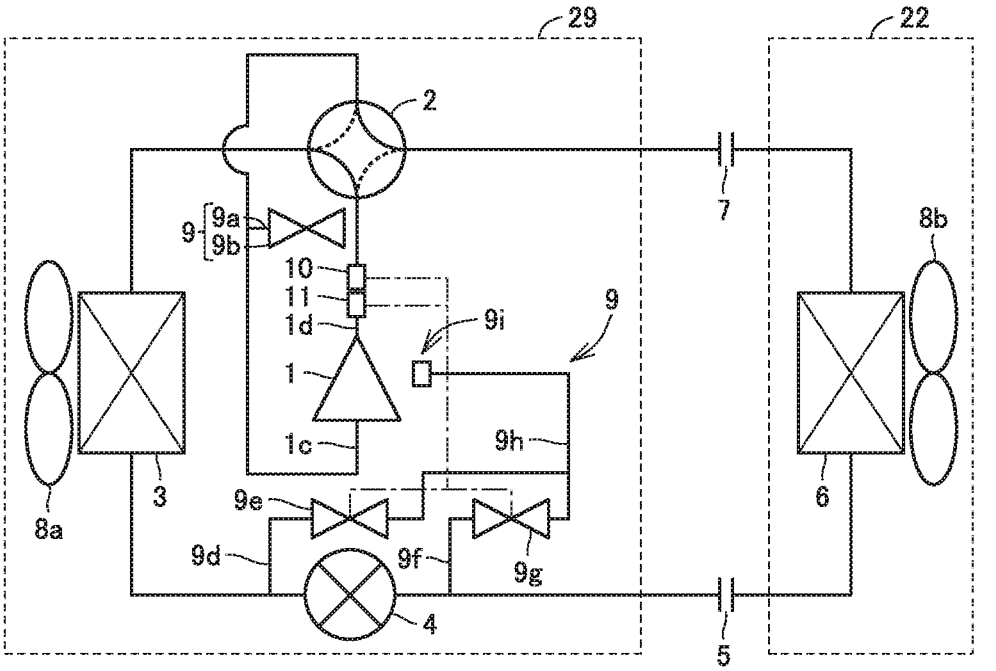
FIG. 15 is a diagram illustrating yet another variation of the refrigeration cycle apparatus according to the first or second embodiment.

Each of refrigeration cycle apparatuses 100, 101, 102, 103 and 104 may include a plurality of jetting units 9. The plurality of jetting units 9 may be provided to be able to jet the refrigerant to a portion (one jet target) of the first refrigerant flow path and the second refrigerant flow path located between the discharge side of compressor 1 and expansion valve 4. Alternatively, referring to FIGS. 13 and 14, the plurality of jetting units 9 may be provided to be able to jet the refrigerant to portions different from each other of the first refrigerant flow path and the second refrigerant flow path located between the discharge side of compressor 1 and expansion valve 4. For example, one of the plurality of jetting units 9 may be provided to be able to jet the refrigerant to compressor 1, while the remainder of the plurality of jetting units 9 may be provided to be able to jet the refrigerant to a portion of the first refrigerant flow path connected between the discharge side of compressor 1 and the condenser. Referring to FIG. 14, each of the plurality of jetting units 9 may include a configuration similar to that of jetting unit 9 shown in FIG. 1. Alternatively, each of the plurality of jetting units 9 may include a configuration similar to that of jetting unit 9 shown in FIG. 3. Alternatively, referring to FIG. 15, one of the plurality of jetting units 9 may include a configuration similar to that of jetting unit 9 shown in FIG. 1, while the remainder may include a configuration similar to that of jetting unit 9 shown in FIG. 3. At least one of the plurality of jetting units 9 may include the plurality of safety valves 9*b* or jet nozzles 9*i*.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The present invention is applied particularly advantageously to a refrigeration cycle apparatus enclosing a refrigerant having potential for disproportionation reaction.

The invention claimed is:

1. A refrigeration cycle apparatus in which a refrigerant having potential for a disproportionation reaction circulates through a compressor, a condenser, an expansion valve, and an evaporator in this order, comprising:

- a first refrigerant flow path connected between a discharge side of the compressor and the condenser;
- a second refrigerant flow path connected between the condenser and the expansion valve;
- a first safety valve connected to the second refrigerant flow path by piping;
- a third refrigerant flow path connected between the expansion valve and a suction side of the compressor, the third refrigerant flow path including:
  - a fourth refrigerant flow path connected between the expansion valve and the evaporator, and
  - a fifth refrigerant flow path connected between the evaporator and the suction side of the compressor;
- a second safety valve connected to the fourth refrigerant flow path by piping; and
- at least one jetting nozzle, wherein the at least one jetting nozzles comprises:
  - a jetting nozzle connected to the fourth refrigerant flow path via the second safety valve, arranged to face the compressor with a distance therebetween, and configured to jet the refrigerant drawn from the fourth refrigerant flow path onto the compressor when at least one of temperature and pressure of the refrigerant in the compressor or the refrigerant discharged from the compressor exceeds an allowed value
  - a jetting nozzle connected to the second refrigerant flow path via the first safety valve, arranged to face the compressor with a distance therebetween, and configured to jet the refrigerant drawn from the second refrigerant flow path onto the compressor when at least one of temperature and pressure of the refrigerant in the compressor or the refrigerant discharged from the compressor exceeds an allowed value;
  - a jetting nozzle connected to the second refrigerant flow path via the first safety valve, arranged to face the first refrigerant flow path with a distance therebetween, and configured to jet the refrigerant drawn from the second refrigerant flow path onto the first refrigerant flow path when at least one of temperature and pressure of the refrigerant in the compressor or the refrigerant discharged from the compressor exceeds an allowed value; or a jetting nozzle connected to the fourth refrigerant flow path via the second safety valve, arranged to face the second refrigerant flow path with a distance therebetween, and configured to jet the refrigerant drawn from the fourth refrigerant flow path onto the second refrigerant flow path when at least one of temperature and pressure of the refrigerant in the compressor or the refrigerant discharged from the compressor exceeds an allowed value, and wherein when the first safety valve or the second safety valve is opened, the operation of the compressor is stopped.

2. The refrigeration cycle apparatus according to claim 1, wherein:

the compressor has a plurality of components, including a slider in which the components slide and a motor configured to drive the slider, and the jetting nozzle jets the refrigerant toward the slider or the motor.

3. The refrigeration cycle apparatus according to claim 2, wherein:

the compressor further includes a guide surrounding the slider or the motor, the guide includes a hollow portion at a position facing the slider or the motor, and the jetting nozzle jets the refrigerant into the hollow portion.

4. A refrigeration cycle apparatus in which a refrigerant having potential for a disproportionation reaction circulates through a compressor, a condenser, an expansion valve, and an evaporator in this order, comprising:

a first refrigerant flow path connected between a discharge side of the compressor and the condenser;

a second refrigerant flow path connected between the condenser and the expansion valve;

a fourth refrigerant flow path connected between the expansion valve and the evaporator;

a fifth refrigerant flow path connected between the evaporator and a suction side of the compressor;

a safety valve connected to the fifth refrigerant flow path by piping; and at least one jetting nozzle, wherein the at least one jetting nozzle comprises:

a jetting nozzle connected to the fifth refrigerant flow path via the safety valve, arranged to face the compressor with a distance therebetween, and configured to jet, as a third refrigerant flow path, the refrigerant drawn from the fifth refrigerant flow path onto the compressor when at least one of temperature and pressure of the refrigerant in the compressor or the refrigerant discharged from the compressor exceeds an allowed value, a jetting nozzle connected to the fifth refrigerant flow path via the safety valve, arranged to face the first refrigerant flow path with a distance therebetween, and configured to jet the refrigerant drawn from the fifth refrigerant flow path onto the first refrigerant flow path when at least one of temperature and pressure of the refrigerant in the compressor or the refrigerant discharged from the compressor exceeds an allowed value, and wherein when the safety valve is opened, the operation of the compressor is stopped.

5. The refrigeration cycle apparatus according to claim 4, wherein:

the compressor has a plurality of components, including a slider in which the components slide and a motor configured to drive the slider, and the jetting nozzle jets the refrigerant toward the slider or the motor.

6. The refrigeration cycle apparatus according to claim 5, wherein:

the compressor further includes a guide surrounding the slider or the motor, the guide is provided with a hollow portion at a position facing the slider or the motor, and the jetting nozzle is provided to be able to jet the refrigerant into the hollow portion.

* * * * *